US005984983A

United States Patent [19]

Asgaonkar et al.

[11] Patent Number: 5,984,983

[45] Date of Patent: Nov. 16, 1999

[54] USE OF CARBONYL COMPOUNDS AS MARKERS

[75] Inventors: Anjali Asgaonkar, Somerset; Haresh Doshi, Somerville, both of N.J.

[73] Assignee: Morton International, Inc., Chicago, Ill.

[21] Appl. No.: 09/206,020

[22] Filed: Dec. 4, 1998

[51] Int. Cl.[6] ..... C10L 1/18

[52] U.S. Cl. ..... 44/385; 44/388; 44/418; 44/437

[58] Field of Search ..... 44/388, 437, 418, 44/385

[56] References Cited

U.S. PATENT DOCUMENTS

| | | | |
|---|---|---|---|
| 4,209,302 | 6/1980 | Orelup . | |
| 4,735,631 | 4/1988 | Orelup . | |
| 5,205,840 | 4/1993 | Friswell et al. | 44/428 |
| 5,252,106 | 10/1993 | Hallisy | 44/328 |
| 5,429,952 | 7/1995 | Garner et al. | 436/518 |
| 5,525,516 | 6/1996 | Krutak et al. | 436/56 |
| 5,776,713 | 7/1998 | Garner | 435/7.92 |

FOREIGN PATENT DOCUMENTS

WO 94/02570 7/1993 WIPO .

*Primary Examiner*—Jacqueline V. Howard
*Assistant Examiner*—Cephia D. Toomer
*Attorney, Agent, or Firm*—Wayne E. Nacker; Gerald K. White

[57] ABSTRACT

Carbonyl compounds, such as ketones, aldehydes, esters, amides, anhydrides and carboxylic acids are added to a material, particularly a liquid material as markers. Subsequently the carbonyl compound(s) are identified by measuring the absorbency peak(s) of the carbonyl compounds in the mid-IR range. Carbonyl compounds soluble in non-polar solvents and substantially insoluble in water are particularly suitable for tagging and identifying petroleum fuels. For use in petroleum fuels, the carbonyl compound(s) preferably contains no element other than carbon, hydrogen, oxygen and nitrogen. Digital carbonyl marker systems, i.e., systems containing two or more carbonyl compounds in predetermined ratios, can be determined quantitatively with instruments, such as SpecTrace™ which measure absorbance in the mid-IR region.

7 Claims, No Drawings

USE OF CARBONYL COMPOUNDS AS MARKERS

The present invention is directed to the use of carbonyl compounds as silent markers for petroleum fuels and other liquids.

BACKGROUND OF THE INVENTION

The practice of tagging petroleum fuels with chemicals for purposes such as tax identification, brand identification, etc. is well established. Such markers are described, for example, in U.S. Pat. Nos. 4,209,302, 4,735,631, 5,205,840, and 5,252,106. These markers are added to petroleum fuels at low levels, e.g., in the 1–100 parts per million by weight (ppm) range. Subsequently, the markers are extracted from the fuel with an acidic or basic aqueous solution and either undergo a chromophoric change caused by the extractant or are simultaneously or subsequently reacted with a reagent which causes it to undergo a chromophoric reaction. While markers such as these have been the standard of the industry, the wet chemistry involved poses certain disadvantages. In particular, the fuel sampled for identification, when exposed to the extractant, cannot be returned to its source. Though the amount of fuel taken for sampling is generally small, the sampled fuel, along with the extracting reagent, require disposal. Increasingly stringent environmental requirements prevent on-site disposal of even small amounts of fuel and fuel-containing specimens. Rather, such samples must be disposed of as hazardous wastes.

Because of the disadvantages of wet chemistry, there is a movement toward tagging and identification methods which are non-destructive in the sense that the fuel specimen may be returned to the reservoir from which it was taken. Recently, Morton International, Inc. has introduced a portable infrared spectrometer with data processing capabilities, sold under the trademark SpecTrace such that one, and preferably more than one, marker can be identified and quantified directly in a specimen of the fuel. As the fuel is exposed to no contaminating chemicals, the specimen can be returned to its source. This apparatus provides for simple and accurate quantitative testing of gasolines in the field.

Truly silent markers which are not visible at any concentration have also been proposed for invisibly tagging petroleum products. These markers are typically large organic molecules that have virtually no absorbance in the visible portion of the spectrum and that absorb and/or fluoresce in the near infrared to mark their presence in a fuel sample. U.S. Pat. No. 5,525,516 (Krutak et al.) and European Patent 0,656,929 (Albert et al.) describe such markers. In these references, the presence of such a marker is detected in the fuel by exposing the fuel to near infrared radiation and then either detecting the characteristic light absorption spectra of the marker or its emitted fluorescent light in the near infrared region with standard absorption or fluorescent detection equipment. While the detection procedure is much simpler, molecules or markers that are active in near infrared are large, complex, organic structures. Therefore, these markers are difficult and expensive to make. Furthermore, there are only a finite number of near infrared absorbing or fluorescing molecules that can serve as silent markers.

There is a continuing need for markers which can be identified spectrophotometrically for identification in SpecTrace or other instruments. There are a number of criteria for such markers. A marker should have at least one strong absorbency peak in a spectral region in which the fuel, fuel additives, and natural contaminants to the fuel do not absorb.

Preferably, the marker is colorless so as to serve as a "silent" marker, although a lightly colored marker may be masked by dyes added to the gasoline. The marker must be non-reactive with the fuel and other fuel additives and must be in no way harmful to the engine in which the fuel is used. Although the marker is added to the fuel at a low level in the fuel, e.g., between about 0.25 and about 100 ppm, it is preferably highly soluble within the fuel. More importantly, a fuel marker should be insoluble in aqueous solutions or substantially so, preferably having a solubility in water of less than about 0.2 g per 100 ml. of water at 20° C. The marker should not be easily removable from the fuel.

A variety of different markers are required for the petroleum fuel industry. With a wide number of taxing bodies throughout the world, a large number of petroleum producers and a variety of different petroleum fuel products, there is a need for individualizing marker systems for different products and different tax levels.

While petroleum fuels are perhaps the most commonly tagged materials, other materials are increasingly being tagged for identification and protection against adulteration. The variety of materials so tagged is expected to increase. Examples of materials that are or may potentially be tagged include refrigerant lubricants, pharmaceuticals, cosmetics, food, liquor, soft drinks, paints, polymers, agricultural chemicals, and rubber. Each of such materials will have individual requirements.

SUMMARY OF THE INVENTION

In accordance with the present invention, materials are tagged with carbonyl compound(s). Subsequently the tagged materials are identified by measuring for the presence of the carbonyl compound(s). A preferred method of detecting the carbonyl compound(s) is through the IR absorbency peaks of the carbonyl group. The method of tagging and identifying is particularly advantageous with respect to petroleum fuels which generally do not contain carbonyl compounds.

In selecting a marker(s) for petroleum fuels, the compound preferably contains only the elements carbon, hydrogen, oxygen and nitrogen, particularly for jurisdictions, such as the US., where such is a governmental requirement. The compound used as a marker should contain no chemical functional group having substantial IR absorbancy at the peak wavelength of the carbonyl group(s) of the marker. For simplicity, economy and to avoid the possibility of interfering absorbency peaks, it is preferred that in addition to the carbonyl group(s) in the marker compound, that the rest of that compound be hydrocarbon having no additional functional groups.

DETAILED DESCRIPTION OF CERTAIN PREFERRED EMBODIMENTS

Carbonyl groups exhibit high absorbency peaks in the mid-IR regions, particularly in the 1500–1900 $cm^{-1}$ range. Accordingly, carbonyl compounds are suitable as markers for materials which do not absorb significantly at such peak wavelengths, providing such carbonyl compounds meet other specific requirements for the material being tagged. It is found that most petroleum fuels, such as gasoline, diesel fuel, kerosene, etc. do not absorb significantly at the peak absorbency wavelengths of carbonyl groups. Accordingly, a number of carbonyl compounds are found to be useful as petroleum fuel markers.

Some additive packages for petroleum fuels do, however, contain carbonyl compounds. If so, the carbonyl compounds in the additive package may serve as the markers in accordance with the invention, provided the mid-IR peak of a carbonyl compound in the additive package diluted in the fuel is sufficiently strong for detection. In tailoring a marking system for a particular fuel with a particular additive package, it is therefore generally necessary to determine if any carbonyl compounds are already present, whether the carbonyl compounds already in the fuel can form the basis of markers, and what additional carbonyl compound(s) might be added as marker(s) which have peak wavelengths different from carbonyl groups of compounds already in the fuel.

There are a variety of carbonyl compound types suitable for use in the present invention, including, but not limited to ketones, aldehydes, esters (including lactones), amides (including lactams and imides), anhydrides and carboxylic acids. The variety of available carbonyl compounds allows individualization of tagging for a variety of products, including, particularly, a variety of petroleum fuel products and petroleum fuel tax packages. The molecular environment of the carbonyl group strongly influences its peak absorbency. The above-mentioned classes of chemicals exhibit absorbency peaks in the following wavelengths:

| Compound type | Peak absorbency range of carbonyl groups ($cm^{-1}$) |
|---|---|
| Ketones | 1560–1760 |
| Aldehydes | 1660–1780 |
| Esters (including lactones) | 1680–1885 |
| Amides (including lactams and imides) | 1620–1740 |
| Anhydrides | 1720–1880 |
| Carboxylic Acids | 1660–1760 |

A single carbonyl compound may be used to tag and identify a material. However, it is often advantageous to tag a material with two or more carbonyl compounds with different carbonyl peaks. This allows for a good deal of flexibility in tagging systems. For example, two different grades of petroleum fuel might be tagged with the same two carbonyl compounds, but in different ratios. If two or more carbonyl compounds are employed as markers, their carbonyl mid-IR absorption peaks should be at least about 5 wave numbers apart, preferably at least about 10 wave numbers apart, more preferably at least about 20 wave numbers apart.

The primary initial use of carbonyl compounds as markers is expected to be in petroleum fuels. Accordingly, such compounds should be highly soluble in non-polar solvents. Herein, it is preferred that the carbonyl compound have a solubility in xylene of at least about 2 g/100 ml. at 20° C. As noted above, the carbonyl compound should have a solubility in water of no more than about 0.2 g/100 ml at 20° C., and more preferably should be effectively insoluble in water.

The carbonyl compound should be non-reactive with the material into which it is introduced. The above-mentioned classes of carbonyl compounds all include specific compounds which do not react with petroleum fuels or common petroleum fuel additives. The carbonyl compound should contain no additional functional group which absorbs IR radiation at or near the carbonyl peak by which identification is to be made. Preferably, except for the carbonyl-functionality of the molecule, the remainder of the molecule is hydrocarbon without additional chemical functionality. However, additional functionality is permissible, so long as the compound as a whole is non-reactive and stable within the petroleum fuel. Again, petroleum fuel manufacturers generally require that a marker contain no elements other than carbon, hydrogen, oxygen and nitrogen. Some specific chemical compounds useful for marking petroleum fuels in the several classes of carbonyl compounds include, but are not limited to:

Ketones: acetophenone, benzophenone, phenanthrenequinone, flavone, anthraquinone, estrone Aldehydes: anisaldehyde, citral Esters: amyl acetate, dibutyl phthalate, diisooctyl phthalate, coumarin Amides: methyl neodecanamide, neodecanamide, benzanilide, glutethimide Carboxylic Acids: 2-ethyl butyric acid, naphthalic acid Anhydrides: benzoic anhydride, cinnamic anhydride.

The amount of carbonyl compound required to tag petroleum fuels can vary from as low as about 0.25 ppm up to about 100 ppm. The amount required for any particular compound will depend largely upon the strength of the carbonyl IR peak and the sensitivity of the instrument used to identify the carbonyl compound in the tagged fuel. Instruments having narrow wavelength filters matched to the carbonyl mid-IR absorbance peak(s) of the tagging compound(s) provide the most sensitivity. Such filters reduce signal-to-noise ratio, thereby improving sensitivity. Because identification of the marker(s) is intended to be quantitative, so as to determine not only the presence of the marker(s), but also potential dilution with adulterating fuels, it is generally preferable to add the marker(s) at a level at least about 10 times the minimal measurable level of the intended measuring instrument.

Many of the suitable carbonyl compounds are relatively inexpensive, particularly relative to more expensive dyes heretofore used as markers. Generally, these compounds are also colorless, meaning that they cannot be detected visually even in the clearest petroleum fuels.

Marking compounds may be added neat to petroleum fuels. However, for reasons such as formulating an additive package, customers may require that the carbonyl compound be provided in dilute form, e.g., as a 20 to 80% solution in a non-polar solvent such as toluene, xylene or a high-boiling aromatic solvent mixture. The marker might be added to a petroleum fuel additive package and introduced to the petroleum fuel as part of that package.

The use of carbonyl compounds is not limited to petroleum fuels. However, from a practical standpoint, such tagging may be limited to materials which do not contain significant levels of carbonyl compounds, e.g., acetic acid in foods or phthalate plasticizers in plastics. For tagging polar materials, particularly water-based materials, the following carbonyl compounds are examples:

Ketones: acetone, cyclohexanone

Aldehydes: furfural, benzaldehyde, glyceraldehyde

Esters: ethyl acetate, caprolactone

Amides: urea, caprolactam, acetamide, succinimide, urethane

Carboxylic acid: acetic acid

Anhydride: butyric anhydride, acetic anhydride

Detection methods other than IR spectroscopy may be used for identifying carbonyl compounds in fluids, e.g. gas chromatography, high performance liquid chromatography and UV spectroscopy. Likewise, the compounds are amenable to detection by chemical methods, although this is not generally desired as a primary advantage of carbonyl compounds is their ability to be detected by their strong and specific absorbance peaks. However, the currently contemplated of detecting carbonyl compounds is by their carbonyl mid-IR absorption peaks. This is particularly true because of the availability of compact, portable instruments such as SpecTrace™ for measuring mid-IR peaks.

Markers are frequently packaged with or used in conjunction with dyes which impart color to the gasoline. Many common oil-soluble dyes do not absorb significantly in the regions of the carbonyl peaks by which the marker compounds of the present invention are identified. Accordingly, the carbonyl compounds used as markers in accordance with the invention can be used as markers in conjunction with such dyes. For example, Automate® dyes Red B, Blue 8, and Yellow 8 sold by Morton International, Inc. have substantially no absorbance in the carbonyl region of the mid-IR spectra, allowing carbonyl compounds to be used as markers in conjunction therewith.

Beyond petroleum fuels, the invention is most applicable to other liquids. However, carbonyl compounds can be used to tag solid materials, providing convenient means are available for substantially quantitatively measuring the carbonyl compound. For example, the carbonyl compound might be extracted with an appropriate solvent and then the IR peak(s) measured. Or a material, such as a solid pharmaceutical tagged with a non-toxic carbonyl compound might be dissolved in an appropriate solvent which also dissolves the carbonyl compound.

The invention will now be described by way of specific example.

EXAMPLE

To a liter of clear gasoline was added dibutyl phthalate (peak absorbance 1740 $cm^{-1}$) to a final concentration of 10 ppm and acetophenone (peak absorbance 1700 $cm^{-1}$) to a final concentration of 20 ppm. Measurements at the peak wavelengths in a SpecTrace™ IR analyzer meter obtained values for each compound within 5% of actual levels added.

What is claimed is:

1. A method of tagging and identifying a petroleum fuel consisting essentially of adding to said petroleum fuel between about 0.25 and about 100 ppm of a carbonyl compound(s) to produce a tagged petroleum fuel and subsequently detecting the presence of said carbonyl compound (s) by measuring the mid-IR absorbency peak(s) of the carbonyl compound(s) said carbonyl compound(s) being selected from the group consisting of ketones, aldehydes, esters amides, anhydrides, and carboxylic acids.

2. The method according to claim 1 wherein said carbonyl compound(s) each contains no additional functional groups which absorb IR radiation at or near the peak wavelength of the carbonyl group(s) being used for identification.

3. The method according to claim 1 wherein each carbonyl compound used as a marker, in addition to its carbonyl group(s), has hydrocarbon groups but no other chemical functional moieties.

4. The method of claim 1 wherein said carbonyl compound(s) are formed from no element other than carbon, hydrogen, oxygen and nitrogen.

5. The method of claim 1 wherein said petroleum fuel is tagged with at least two carbonyl compounds in a predetermined ratio providing carbonyl functional groups having peak absorbency peaks at least about 5 wavenumbers apart, and the presence and amounts of each of the carbonyl compounds is identified by its mid-IR absorbency peak.

6. The method of claim 1 wherein said material is a petroleum fuel and said carbonyl compound(s) each has a solubility at 20° C. in xylene of at least about 2 g/100 ml and a solubility in water of no more than about 0.2 g/100 ml.

7. The method of claim 1, wherein said petroleum fuel contains a dye which imparts color to said petroleum fuel, said dye having no significant IR absorption in the carbonyl region of the spectrum.

* * * * *